US005411418A

United States Patent [19]

Welsh et al.

[11] Patent Number: 5,411,418

[45] Date of Patent: May 2, 1995

[54] REPAIRABLE SOLDERLESS CONNECTOR ARRANGEMENT

[75] Inventors: David E. Welsh, Tustin; Peter J. Hyzin, Lake Forest, both of Calif.

[73] Assignee: ITT Corporation, Secaucus, N.J.

[21] Appl. No.: 115,488

[22] Filed: Sep. 1, 1993

[51] Int. Cl.[6] ..... H01R 13/42

[52] U.S. Cl. ..... 439/751; 29/426.5; 29/762; 29/845

[58] Field of Search ..... 439/751; 29/426.5, 762, 29/769, 892, 895

[56] References Cited

U.S. PATENT DOCUMENTS

| | | | |
|---|---|---|---|
| Re. 33,153 | 1/1980 | Althouse et al. | 439/608 |
| 3,545,080 | 12/1970 | Evans | 29/629 |
| 3,634,819 | 1/1972 | Evans | 339/252 |
| 3,807,045 | 4/1974 | Bennett et al. | 29/895 |
| 3,854,788 | 12/1974 | Goodman | 339/176 |
| 4,206,964 | 6/1980 | Olsson | 339/221 |
| 4,402,133 | 9/1983 | Crabbs et al. | 29/764 X |
| 4,513,499 | 4/1985 | Roldan | 29/874 |
| 4,533,204 | 8/1985 | Moynagh, Jr. et al. | 339/221 |
| 4,596,437 | 6/1986 | Rush | 439/751 X |
| 4,737,114 | 4/1988 | Yaegashi | 439/82 |
| 4,793,817 | 12/1988 | Hiesbock | 439/82 |
| 4,904,212 | 2/1990 | Durbin et al. | 439/751 |
| 4,997,379 | 3/1991 | Rozmus | 439/84 |
| 5,078,612 | 1/1992 | Rozmus | 439/84 |

OTHER PUBLICATIONS

Berg Compliant Press-Fit Edge Card Connector; DuPont Company, Data Sheet 7020; Dec., 1982.

*Primary Examiner*—Eugene F. Desmond
*Attorney, Agent, or Firm*—Thomas L. Peterson

[57] ABSTRACT

A method is described for fabricating an arrangement where a connector (12, FIG. 1) lies on a circuit board (14) and contacts (26) have forward contact parts lying in passages (18) of the connector insulator (16) and board-received contact parts lying in interference fit in holes (24) of the circuit board, which facilitates replacement of a single damaged contact. An installing tool (70, FIG. 3) has channels (80) that receive the forward contact parts (40) and leave the board-received contact parts (32) projecting therefrom. The installing tool with contacts therein is moved towards the circuit board to press the projecting board-received parts of the contacts into the circuit board holes (24). The installing tool is then removed, leaving the contacts behind with their forward parts projecting up from the circuit board. The connector insulator (16, FIG. 4) is then moved so its passages receive the forward contact parts, the connector then being fastened to the circuit board. Because of the fact that the insulator does not press the contacts into place, there is no need for abutments on the insulator to engage shoulders on the contacts, and therefore an individual contact can be pulled forwardly out of the circuit board and connector.

7 Claims, 4 Drawing Sheets

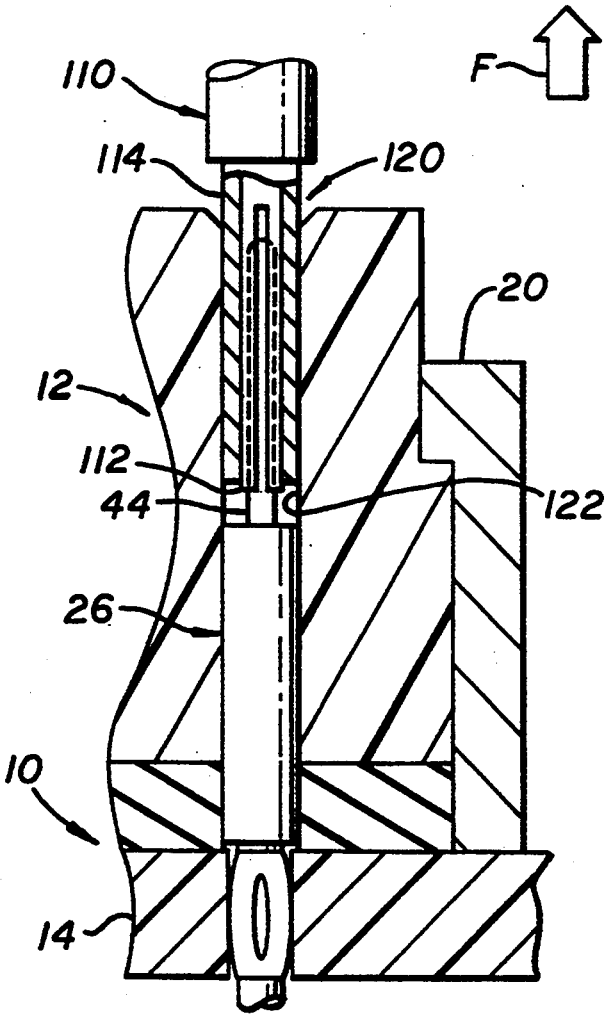
FIG. 5
FIG. 7
PRIOR ART
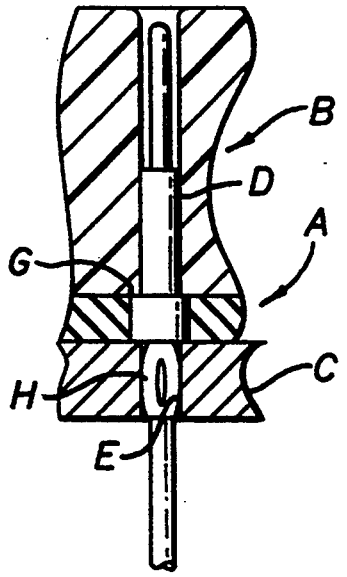

REPAIRABLE SOLDERLESS CONNECTOR ARRANGEMENT

BACKGROUND OF THE INVENTION:

One type of solderless connector termination system, includes contacts with forward parts lying in the connector insulator, and with board-received parts press fit into plated-through holes of a circuit board or the like. Solder is not used to hold and connect the board-received parts to the plated holes in the board, principally where the circuit board has ground planes and is thick and difficult to quickly heat. The system is assembled by first inserting the forward connector parts into the insulator passages. The insulator is pressed forcefully towards the circuit board to press the board-received parts into interference fit with the circuit board holes. It may be noted that other systems use solid board-received contact parts for press fit in the circuit board holes, although newer systems use more compliant board-received parts such as those with a slot resembling the eye of a needle.

In order for the insulator to press firmly against the contacts to press fit the board-received contact parts into the board holes, the insulator was formed with rearwardly-facing abutments that abutted forwardly-facing shoulders on the contacts. If a contact should become damaged, it was replaced by removing screws that held the connector to the circuit board, removing the connector insulator, replacing the damaged contact from the rear of the insulator, and reinstalling the connector insulator. Some systems use a group of connectors and various fastening devices that hold them in place. In that case, the removal of a single connector insulator to replace one or a few damaged contacts, takes considerable time. It would be desirable if a single contact could be replaced from the front or mating end of the connector without having to detach the connector from the circuit board or other device in which the contacts are press fit.

SUMMARY OF THE INVENTION

In accordance with one embodiment of the present invention, a method for fabricating a connector and board combination is provided, as well as the combination itself, which facilitates replacement of a damaged contact. The forward parts of the contacts are installed in channels of an installing tool, with the board-received parts projecting rearwardly from the tool. The tool is then moved towards the circuit board and presses against the contacts to press their board-received parts into interference fit with the circuit board holes. The installing tool is removed and the connector is mounted to the circuit board, with passages of the connector insulator receiving the forward parts of the contacts. In the resulting connector and circuit board combination, the contacts do not have any shoulders lying against a rearwardly-facing abutment of the insulator. As a result, a single damaged contact can be removed by inserting a removal tool device into an insulator passage, gripping the contact forward part, and pulling out the damaged contact. A replacement contact can be installed by projecting it through the front of an insulator passage until the board-received part of the contact is press fit into the corresponding circuit board hole.

The novel features of the invention are set forth with particularity in the appended claims. The invention will be best understood from the following description when read in conjunction with the accompanying drawings.

BRIEF DESCRIPTION OF THE DRAWINGS

FIG. 5 is a partial sectional view of the combination of FIG. 1, and showing a removal device in the process of the removal of a contact from the combination.

FIG. 7 is a partial sectional view of a connector and circuit board combination of the prior art.

DESCRIPTION OF THE PREFERRED EMBODIMENTS

Figure 1:
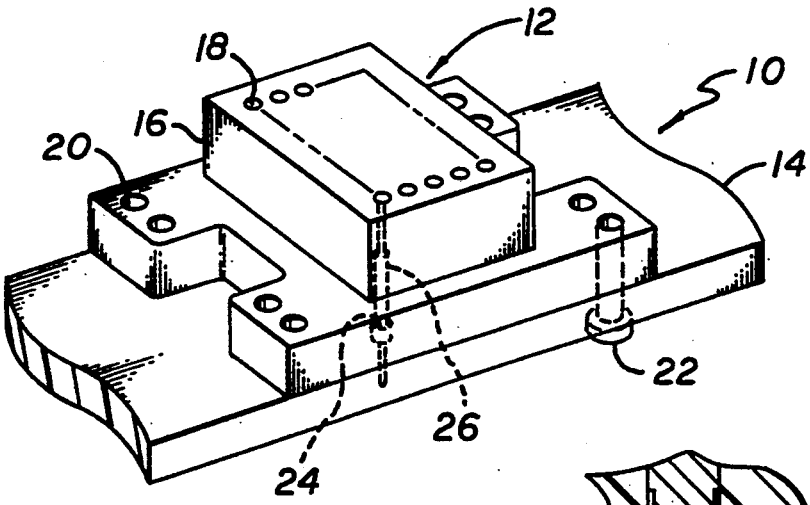
FIG. 1 is a partial isometric view of a combination of circuit board and connector, constructed in accordance with the present invention.

FIG. 1 illustrates a combination 10 of a connector 12 and circuit board 14 of the present invention. The connector includes a dielectric insulator 16 that has contact-receiving passages 18 arranged in columns and rows. The connector also includes a frame 20 that holds down the insulator to the circuit board, as by screws 22. The circuit board has holes 24 aligned with the passages 18 in the insulator, and contacts 26 lie in the combination, with contact parts in both the insulator passages and the circuit board holes.

Figure 2:
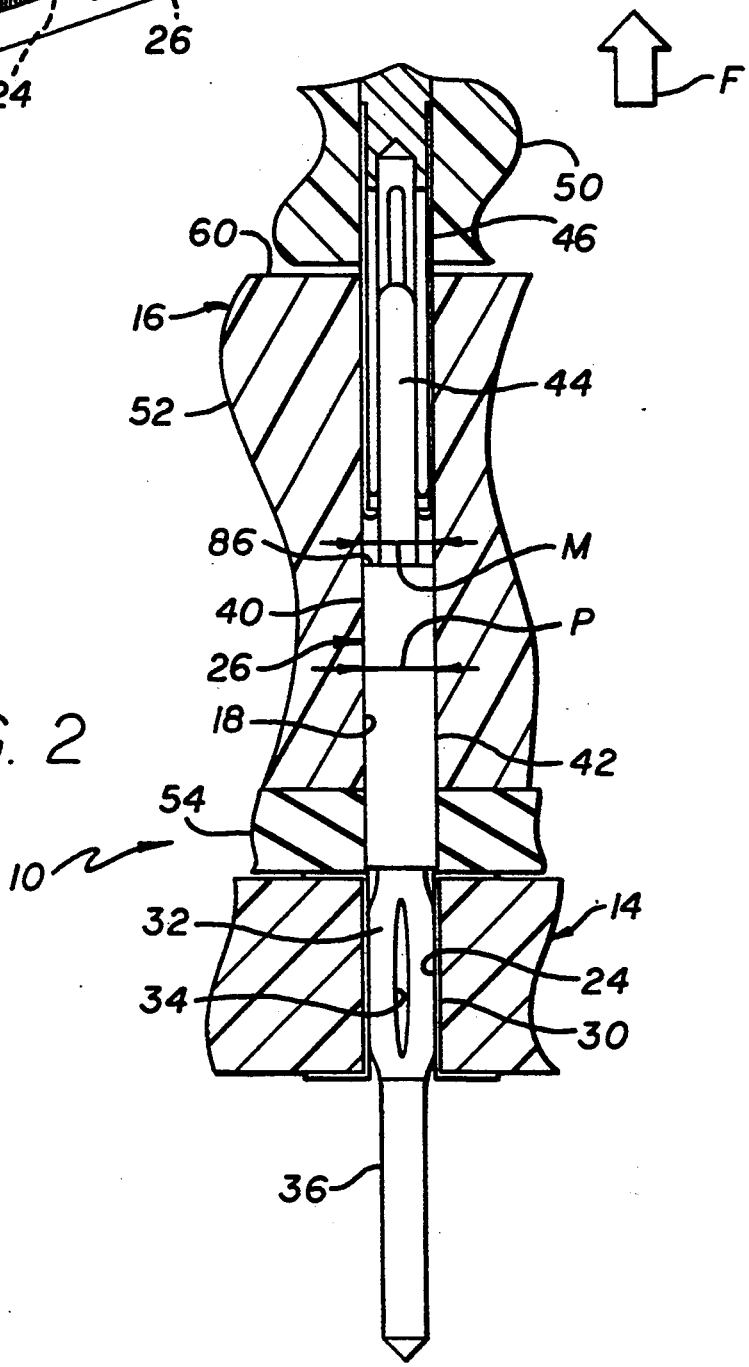
FIG. 2 is a partial sectional view of the combination of FIG. 1, and showing a portion of a connector device mated with the connector.

As shown in FIG. 2, each circuit board hole 24 has a plating 30, and each contact has a board-received part 32 that lies in the hole and that firmly engages the plating. The board-received part 32 is preferably compliant, and is of the "eye of the needle" type which has an elongated vertical slot 34 that results in two arms that can be resiliently pressed together. The compliant board-received part 32 lies in a press fit or interference fit in the circuit board hole, so that considerable force is required to both install the part in the board hole and remove it therefrom. This type of connection is often used where the circuit board has ground planes and is thick, and is therefore difficult to quickly heat to a soldering temperature as by dipping into molten solder. It may be noted that the holding force relies to some extent upon the resilience of the circuit board, and that various board-received parts have been used including solid pin types. An extreme contact rear end part 36 extends rearwardly from the board-received part 32 for connection to a wire or the like, the particular part 36 being in the form of a wire wrap pin. Devices other than conventional circuit boards can be part of the combination, and any device with holes that receive contact parts in a press fit and that lie rearward of the connector is included in the term "circuit board".

The contact has a forward part 40 which lies in the connector passage 18. The forward part has a substantially cylindrical rear portion 42 that is closely received in the cylindrical insulator passage 18. The forward part also includes a forward mating portion 44 which mates with a corresponding contact 46 of a mating connector device 50. The particular mating portion 44 is a pin type and the matings contact 46 is a socket type, although the mating portion 44 could be a socket type. The insulator 16 includes a rigid plastic body 52 and a rubber grommet 54 at its rear end.

It can be seen in FIG. 2 that all portions of the contact 26 have a width or diameter P which is no greater than the diameter M of the insulator passage 18. As a result, a damaged contact can be removed by pulling it in a forward direction F out of the combination connector and circuit board, from the front end 60 of the connector. FIG. 7 shows one prior art combination A of a connector insulator B and circuit board C, wherein the insulator B of rigid plastic was used to insert the contact D into the circuit board hole E. In that case, the contact was formed with a forwardly-facing shoulder G that abutted the insulator B. The contacts D were loaded into the insulator, and the board C was pressed towards the insulator, until the compliant board-received parts H were press fit into the circuit board holes. This prior art arrangement prevented removal of a damaged contact from the front end of the connector insulator, and its replacement from the front end of the insulator. As mentioned above, applicant's arrangement shown in FIG. 2, enables withdrawal and replacement from the front end of the insulator.

Figure 3:
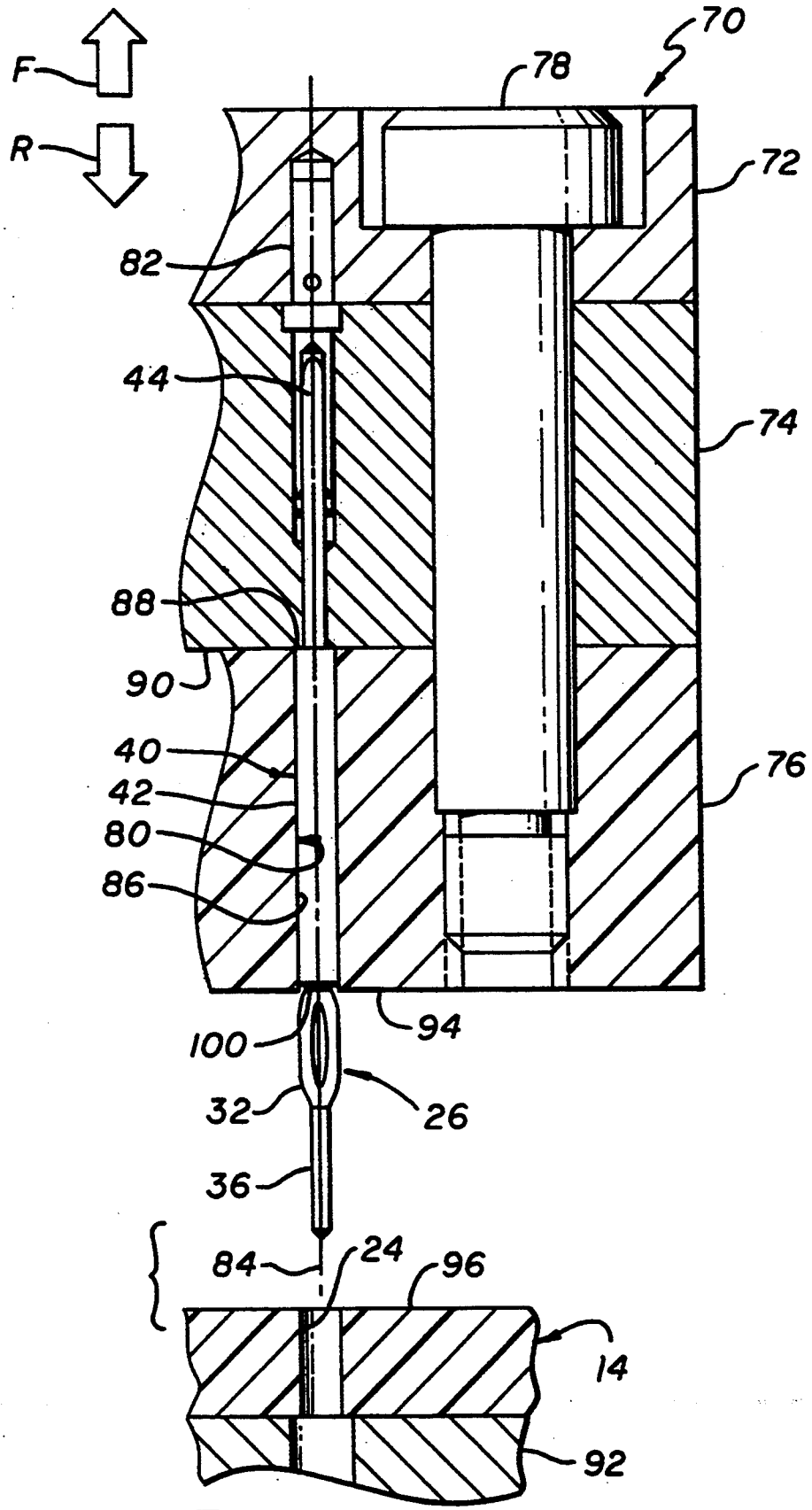
FIG. 3 is a partial exploded sectional view of an installing tool with a contact therein, and of the circuit board of FIG. 1, showing a step in the fabrication method of the invention.

FIG. 3 shows one step in the assembly of the combination of the present invention. Applicant provides a special installing appliance or tool 70 which includes three main parts comprising a gripper 72, pusher 74, and aligner 76 all held together by screws 78. The forward part 40 of the contact is pressed forwardly into a cylindrical channel 80 of the installing appliance, until the mating portion 44 of the contact is held by a gripper device 82. The gripper device 82 is of a construction similar to that of a typical socket contact, with two or three beams that press around the pin mating portion 44 to lightly grip it. The cylindrical rear portions 42 of the contact forward parts are held in alignment with their axes 84 precisely parallel to each other, by an aligner channel portion 86. The installing tool is placed forward of the circuit board 14 and the tool is moved rearwardly until the contact board-received parts 32 begin to enter the circuit board holes 24. Each contact has a forwardly-facing shoulder 88 which abuts shoulder regions 90 of the pusher 74 of the installing tool. The shoulder regions 90 exert rearward force on the contacts, while the circuit board 14 is supported by a support 92, until the board-received parts 32 of the contacts are fully press fit into the board holes. Generally, the tool is moved rearwardly until a rear surface 94 of the tool abuts a forward surface 96 of the board, although this is not necessary. Applicant prefers to form the channel 80 in the installing appliance so a rearwardly-facing shoulder 100 formed at the rear end of the contact forward part, lies slightly forward of the rear surface 94. This prevents the contact shoulder 100 from pressing against the board forward surface 96 and damaging the board. The board-received parts 32 of the contacts are held to the board much more securely than the contact mating portions 44 are held to the gripper 82. As a result, the installing tool 70 can be lifted off the board, with all of the contacts remaining on the board.

Figure 4:
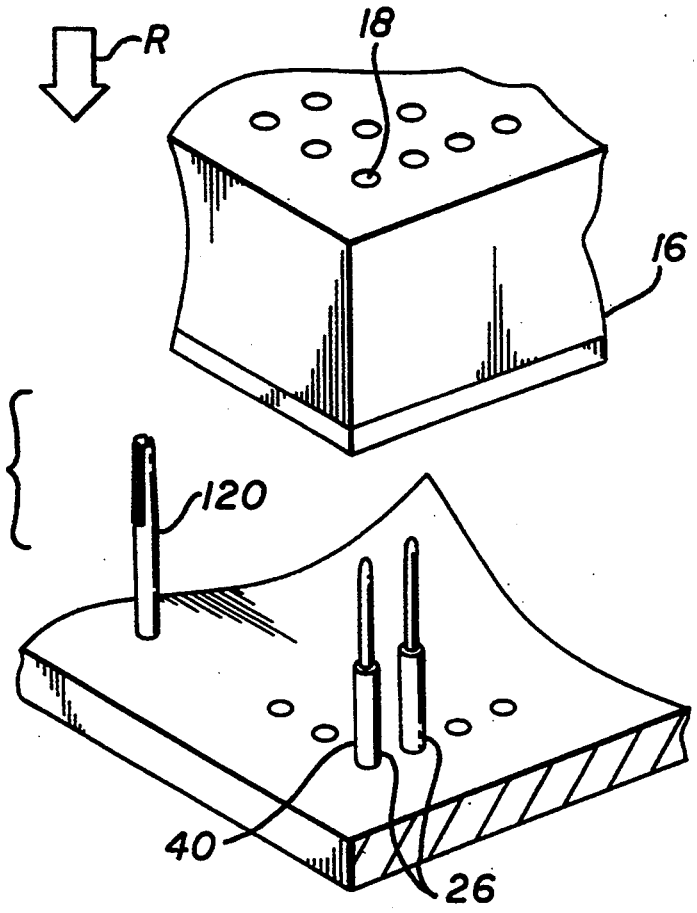
FIG. 4 is a partial exploded isometric view of the combination of FIG. 1, and showing a step in the fabrication of the combination.

FIG. 4 shows the circuit board 14 with the contacts 26 installed thereon, and after the installing tool has been removed. The next step is to install the connector insulator 16. This is accomplished by merely aligning the insulator passages 18 with the contacts and moving the insulator rearwardly to receive the contacts, generally by applying only a moderate rearward force on the insulator. Thereafter, the frame 20 (FIG. 1) of the connector is installed around the insulator and screws 22 are installed to firmly connect the board and connector. The insulator may already have the frame attached to it.

FIG. 5 shows a removal tool or device 110 which is used to pull a contact 26 out of the combination 10 of connector 12 and circuit board 14. The particular removal device 110 is a collet, such as the type used on machine tool spindles to hold milling bits or the like. The device has three beams 112 that lightly grip the mating part 44 of the contact, and also includes a continuous sleeve 114 that can be screwed to advance rearwardly and thereby tightly grip the beams 114 to cause them to tightly grip the contact mating portion 44. After tightly gripping the contact, the removal device 110 is pulled forwardly to pull out the contact. A variety of removal devices can be used, such as a device that cuts threads in the mating portion 44 of the contact to grip it before pulling out the contact. It is noted that the removal device 110 has an annular part 120 formed by the beams 112 and sleeve 114, that fits into an annular gap 122 between the contact pin portion and the passage.

Figure 6:
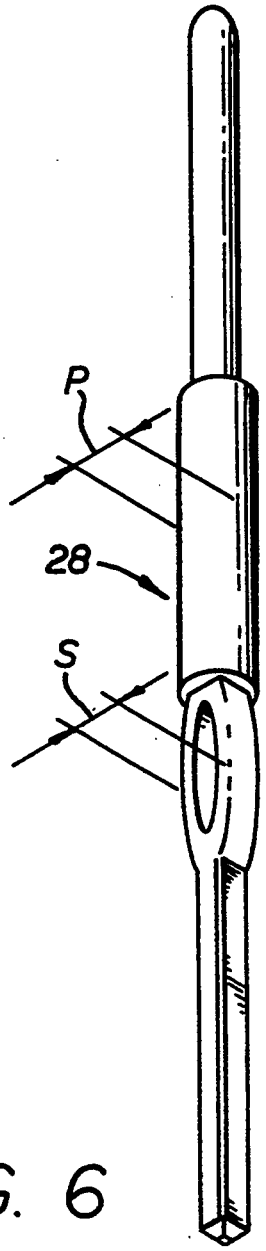
FIG. 6 is an isometric view of one of the contacts of the connector of FIG. 1.

In one design that applicant has implemented, wherein the contact had a maximum diameter P of about 1.3 mm, it required about twenty pounds (9 kg) to both insert and remove the compliant board-receiving part 32 of the contact from the circuit board hole. The other dimensions of the contact relative to the maximum diameter P, are as illustrated in the drawings. Of course, the width S (FIG. 6) of the umcompressed board-received part of the contact is no greater than the width P.

Thus, the invention provides a method for fabricating a combination circuit board and connector for easy replacement of a damaged contact, as well as providing the combination of connector and circuit board and the installation tool therefor. The method includes installing the forward parts of contacts in an installing tool with rear board-received parts of the contacts projecting therefrom, and using the installing tool to press the usually compliant board-received parts into the circuit board holes. The connector insulator then can be installed around the projecting forward contact parts. This method avoids the need for the insulator to have abutments that abut forwardly-facing shoulders on the contacts, and for the contacts to having corresponding shoulder locations that are wider than more forward parts of the insulator passage. As a result, applicant's contacts can be readily pulled out of the combination and a new contact installed, both from the forward end of the connector. Thus, in the combination of the connector and circuit board, the board-received part and the forward part of each contact is of no greater diameter than the connector insulator passages, to allow the contacts to be pulled out from the front end of the combination. The installing tool includes a gripper with a gripper device that grips the contact, preferably at the mating portion thereof, a pusher with shoulder regions that can press against forwardly-facing shoulders on the contacts, and an aligner that aligns the contacts so their axes are precisely parallel to each other. It may be noted that the method can be used in connection with those contacts having socket mating portions, such as shown at 120 in FIG. 4, with special removal tools being required to engage and pull out such socket contacts.

Although particular embodiments of the invention have been described and illustrated herein, it is recognized that modifications and variations may readily occur to those skilled in the art, and consequently, it is intended that the claims be interpreted to cover such modifications and equivalents.

It is claimed:

1. A combination of a circuit board which has a plurality of holes, and a connector which lies adjacent to said circuit board and which has an insulator with passages therein aligned with said circuit board holes and a plurality of contacts, wherein each contact has a compliant board-received contact part which lies in a solderless interference fit in one of said circuit board holes and each contact has a forward contact part lying in one of said insulator passages, characterized by:

said board-received contact part and said forward contact part of each contact is of no greater width than each corresponding insulator passage, so each contact can be individually pulled in a forward direction out through said circuit board and insulator;

each insulator passage has a smallest width which is at least as great as the greatest width of said forward contact part of the corresponding contact, to enable the insulator to be moved rearwardly substantially against said circuit board and receive said forward contact part, after said board-received contact part has been installed in one of said circuit board holes.

2. A method for fabricating for easy repair, a combination circuit board and connector, including forming an insulator with passages, forming a plurality of contacts that have axes and that have forward contact parts and board-received contact parts, including installing said contacts so said forward contact parts lie in corresponding ones of said passages and said board-received contact parts project rearwardly from said body and lie in interference fit in corresponding holes in said circuit board, characterized by:

installing said contacts in an installing tool with said board-received contact parts projecting rearwardly from said installing tool and with said tool holding said contacts aligned with their axes parallel to each other;

moving said tool rearwardly toward said circuit board while pressing said tool against said contacts to press said board-received contact parts into said board holes in interference fit therewith;

withdrawing said tool from said board and contacts and installing said insulator on said board including receiving said forward contact parts in said insulator passages;

said step of constructing said contacts includes forming them so no part of a contact is wider than a corresponding insulator passage to enable a single contact to be pulled forwardly out of the combination through a corresponding passage.

3. A method for installing contacts that have compliant board-received contact parts which are to be inserted rearwardly into holes of a circuit board and that have forward contact parts that are to be installed in passages of a connector insulator wherein the forward contact parts have largely forwardly-facing contact shoulders that are pressed rearwardly during insertion of the board-received contact part into a circuit board, characterized by:

inserting the forward contact parts in an installing tool, with the board-received contact parts projecting therefrom, and with shoulder regions of said tool abutting said contact shoulders;

pressing the installing tool toward the circuit board to install the board-received contact parts in the circuit board holes primarily by force applied by said shoulder regions to said contact shoulders;

removing said installing tool from said contacts while leaving said board-received contact parts in said circuit board and said forward contact parts projecting forwardly from said circuit board, and pressing said insulator rearwardly toward said board while said forward contact parts enter said insulator passages, to thereby avoid the need for insulator passage shoulder regions to press down against said contacts so the contacts can be removed forwardly through the insert passages.

4. Apparatus for use in constructing a combination of a connector and a circuit board wherein the circuit board and an insulator of the connector lie facewise adjacent to each other with holes in the board aligned with passages in the insulator, and wherein a plurality of contacts each have a board-received contact part lying in a solderless interference fit in a board hole and a forward contact part lying in an insulator passage and forming a generally forwardly-facing contact shoulder, characterized by:

a contact installation tool which includes a plurality of grippers which holds said contacts and a plurality of shoulder regions which each lie against said contact Shoulders to press them rearwardly to press said contacts into said circuit board holes.

5. The apparatus described in claim 4 wherein:

said forward contact parts each have forward and rearward portions, said rearward portions being elongated and substantially cylindrical and having an axis and having a front end that forms one of said contact shoulders;

said tool includes a plurality of aligner channel portions that each holds a contact so said axes of said contact rearward portions all extend precisely parallel to each other.

6. The apparatus described in claim 4 including said contacts and wherein:

each of said board-received contact portions is compliant to form a solderless board hole connection;

each of said forward contact parts has a cylindrical rear portion, and said installation tool has a plurality of channels with channel portions of a diameter to closely receive one of said contact cylindrical rear portions;

said forward contact parts lie in said installation tool with said contact cylindrical rear portions in said channel portions and said board-received contact parts projecting rearwardly from said installation tool, with each contact having a maximum width no greater than the width of one of said channel portions.

7. A combination of a circuit board which has a plurality of holes, and a connector which lies adjacent to said circuit board, wherein said connector has an insulator with passages therein aligned with said circuit board holes and a plurality of contacts, wherein each contact has a compliant board-received contact part which lies in a solderless interference fit in one of said circuit board holes and each contact has a forward contact part lying in one of said insulator passages, characterized by:

said board-received contact part and said forward contact part of each contact is of no greater width than each corresponding insulator passage, so each contact can be individually pulled in a forward direction out through said circuit board and insulator;

each of said insulator passages is substantially cylindrical and each of said forward contact parts includes a cylindrical rear portion of about the same diameter as said passage and lying therein and a pin portion extending forwardly from said rear portion and of smaller diameter than said passage to leave an annular gap between them; and including a contact extraction device which has an annular part that can fit into said annular gap and which is constructed to engage said pin portion tightly enough to pull said contact out of said circuit board and insulator.

* * * * *